US005084652A

United States Patent [19]

Kakitani

[11] Patent Number: 5,084,652

[45] Date of Patent: Jan. 28, 1992

[54] FLUORESCENT LAMP LIGHTING APPARATUS

[75] Inventor: Tsutomu Kakitani, Yokohama, Japan

[73] Assignee: Toshiba Lighting & Technology Corporation, Tokyo, Japan

[21] Appl. No.: 574,782

[22] Filed: Aug. 30, 1990

[30] Foreign Application Priority Data

Aug. 31, 1989 [JP] Japan ..... 1-225745

[51] Int. Cl.[5] ..... H05B 37/02

[52] U.S. Cl. ..... 315/219; 315/DIG. 7; 315/223; 315/243

[58] Field of Search ..... 315/219, 223, 242, 243, 315/DIG. 7, DIG. 2, 226

[56] References Cited

U.S. PATENT DOCUMENTS

| | | | |
|---|---|---|---|
| 4,388,563 | 6/1983 | Hyltin | 315/226 |
| 4,503,363 | 3/1985 | Nilssen | 315/225 |
| 4,525,648 | 6/1985 | De Bijl et al. | 315/DIG. 7 |
| 4,544,863 | 10/1985 | Hashimoto | 315/DIG. 7 |
| 4,560,908 | 12/1985 | Stupp et al. | 315/219 |
| 4,701,671 | 10/1987 | Stupp et al. | 315/219 |
| 4,723,098 | 2/1988 | Grubbs | 315/DIG. 7 |
| 4,935,862 | 6/1990 | Herbsleb et al. | 315/DIG. 7 |

FOREIGN PATENT DOCUMENTS

| | | |
|---|---|---|
| 0178852 | 4/1986 | European Pat. Off. . |
| 0198632 | 10/1986 | European Pat. Off. . |
| 3031322 | 4/1982 | Fed. Rep. of Germany . |
| 2532511 | 3/1984 | France . |
| 2627342 | 8/1989 | France . |

*Primary Examiner*—Eugene R. LaRoche
*Assistant Examiner*—Tan Dinh
*Attorney, Agent, or Firm*—Cushman, Darby & Cushman

[57] ABSTRACT

A fluorescent lamp lighting apparatus comprising a DC power source, a pair of field-effect transistors which are connected in series to each other, in which drains and sources of these transistors are connected in series to each other, whereas gates are connected to an oscillator, a pair of voltage-dividing capacitors which are connected in parallel to the DC power source, and an inverter circuit having an insulative leakage transformer whose primary coil is connected to a contact between these field-effect transistors and also to the other contact between those capacitors. One-end of filaments of a fluorescent lamp are connected to both ends of the secondary coil of the leakage transformer, whereas a startup capacitor is connected between the other ends of the filaments. By provision of a series resonant circuit composed of the secondary coil and the startup capacitor, part of the series resonant circuit is released while the fluorescent lamp is off from the lighting apparatus, thus minimizing the resonant output.

15 Claims, 5 Drawing Sheets

FLUORESCENT LAMP LIGHTING APPARATUS

BACKGROUND OF THE INVENTION

1. Field of the Invention

The present invention relates to a fluorescent lamp lighting apparatus, and more particularly, to a fluorescent lamp lighting apparatus using an inverter circuit.

2. Description of the Related Art

Generally, any conventional apparatus for lighting an electric discharge lamp like a fluorescent lamp for example uses an inverter circuit. For example, a typical conventional fluorescent lamp lighting apparatus has the structure described below. The positive electrode of DC power source is connected to the drain of the first field-effect transistor, whereas the negative electrode of this DC power source is connected to the source of the second field-effect transistor. The source of the first field-effect transistor is connected to the drain of the second field-effect transistor and also to an end of the primary coil of a leakage transformer. The other end of this primary coil is connected to a contact between the first and second capacitors which are connected in series between both ends of the DC power source. Furthermore, one ends of filaments on both sides of a fluorescent lamp are connected to both ends of the secondary coil of this leakage transformer. The other ends of these filaments are connected to such portions slightly inside of the both ends of the secondary coil. A startup capacitor is connected in parallel between the other sides of these filaments.

Assume that the first and second field-effect transistors of the lighting apparatus having the above structure are alternately turned ON and OFF. Then, DC voltage delivered from the DC power source is converted into AC voltage to induce alternate current on the part of the secondary coil of the leakage transformer before eventually lighting up the fluorescent lamp. Nevertheless, this conventional fluorescent lamp lighting apparatus magnifies resonant current when no load is present in the apparatus. This in turn causes the first and second field-effect transistors to incur unwanted destruction in some cases. To prevent this, all the conventional fluorescent lamp light apparatuses need to install an independent safety circuit. To prevent these field-effect transistors from incurring unwanted destruction, there is such a conventional electric-discharge lamp lighting apparatus having a typical structure described below.

The positive electrode of the DC power source is connected to the drain side of the first field-effect transistor having the source connected to the drain of the second field-effect transistor. The negative electrode of this DC power source is connected to the source of the second field-effect transistor. The first and second capacitors are connected to each other in series, which are respectively connected between both ends of the DC power source. An end of one of filaments of a fluorescent lamp is connected to the contact between the first and second field-effect transistors via a reactor. An end of the other filament of this fluorescent lamp is connected to the contact between the first and second capacitors. A startup capacitor is connected between the other end of one of these filaments and the other end of the other filaments.

The first and second field-effect transistors of the fluorescent lamp lighting apparatus having the above structure are alternately turned ON and OFF to convert DC voltage into the predetermined AC voltage so that the fluorescent lamp can be lit up. While the fluorescent lamp is not loaded in the lighting apparatus, circuits of this lighting apparatus remain open and inoperative so that the first and second field-effect transistors can be prevented from incurring unwanted destruction while no load is present.

Nevertheless, there is no means of insulating the fluorescent lamp itself from the DC power supply source, and thus, there is potential fear to incur electric shock while loading and unloading the fluorescent lamp.

SUMMARY OF THE INVENTION

Therefore, the object of the present invention is to provide a novel apparatus for lighting up a fluorescent lamp, which securely prevents an inverter circuit from incurring destruction without the need of independently providing a safety circuit and also electric shock from occurring while loading and unloading a fluorescent lamp.

According to an aspect of the present invention, there is provided, a fluorescent lamp lighting apparatus comprising a DC power source, an inverter means including a pair of switching elements serially connected to each other for converting into AC DC delivered from the DC power source, and a series resonant circuit having inductive elements and capacitance elements, at least one of the inductive elements having an insulative transformer, and a fluorescent lamp means, including a pair of filaments, to be lit up on receipt of AC output converted by the inverter means, each filament having one-end and the other end, wherein the series resonant circuit is formed by connecting at least the insulative transformer between one ends of the pair of filaments, and connecting at least one element within a selected group selected between a group of the inductive elements and a group of the capacitance elements between the other ends of the pair of filaments.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Referring now more particularly to the accompanying drawings, embodiments of the invention are described below.

Figure 1:
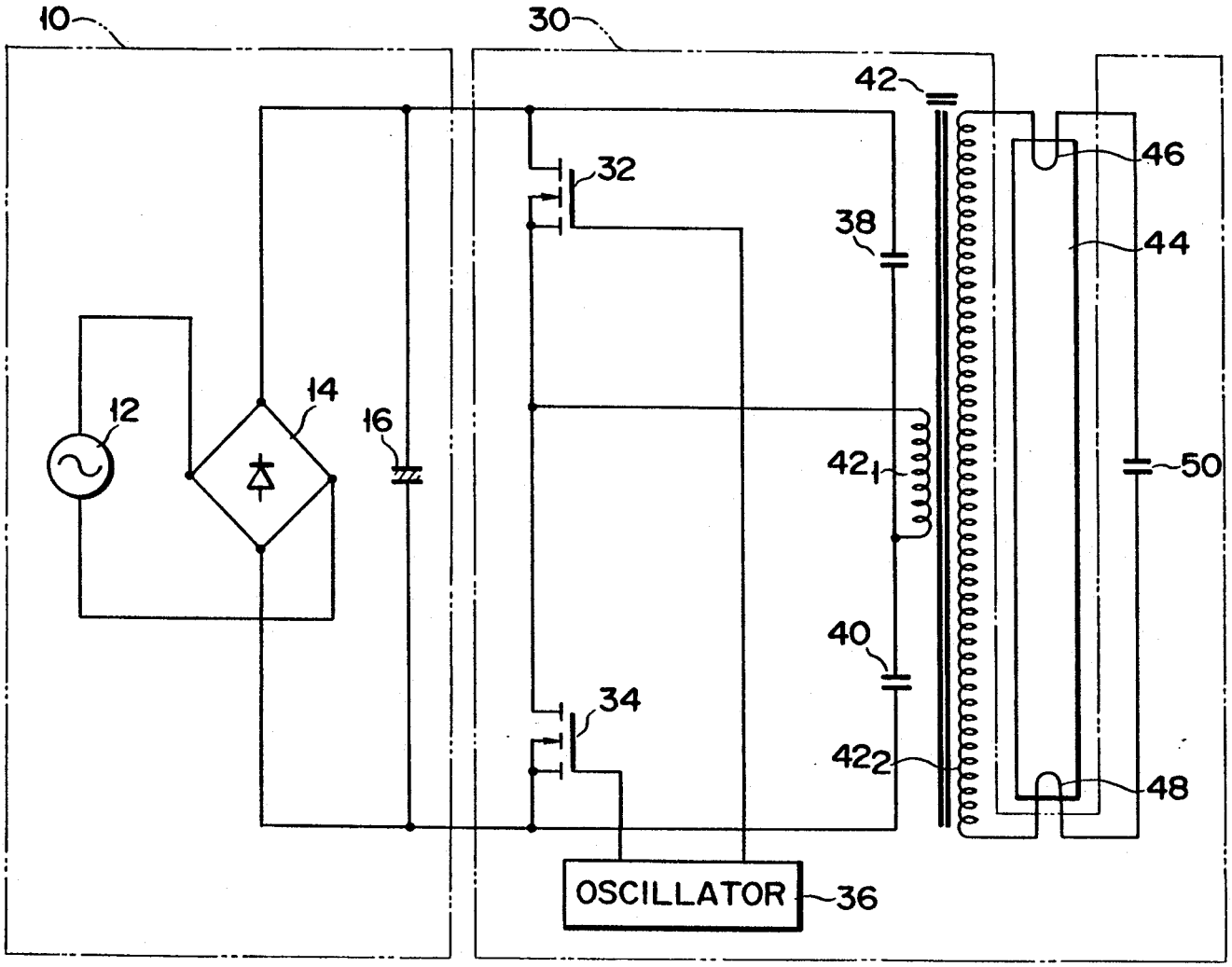
FIG. 1 is a schematic circuit block diagram of the fluorescent lamp lighting apparatus according to an embodiment of the invention.

FIG. 1 illustrates the schematic circuit block diagram of the fluorescent lamp lighting apparatus reflecting an embodiment of the invention. The reference numeral 10 shown in FIG. 1 designates a DC power source. AC input terminals of rectifying circuit 14 of the DC power source 10 are connected to both terminals of a commercially available AC power source 12, whereas AC output terminals of the rectifying circuit 14 are connected to both terminals of a voltage-smoothing electrolytic capacitor 16. One of the terminals of the electrolytic capacitor 16 makes up the positive output terminal of the DC power source 10, whereas the other terminal makes up the negative terminal of the DC power source 10.

A half-bridge type inverter 30 is connected to both terminals of the electrolytic capacitor 16 of the DC power source 10. The inverter circuit 30 incorporates a pair of switching elements 32 and 34 which are connected to each other in series. Concretely, drain of a field-effect transistor functioning as the switching element 32 is connected to the positive output terminal of the DC power source 10. Source of the other field-effect transistor functioning as the switching element 34 is connected to the negative output terminal of the DC power source 10. Source of the field-effect transistor 32 and drain of the field-effect transistor 34 are connected to each other. An oscillator 36 is connected to gate sides of these field-effect transistors 32 and 34.

Capacitors 38 and 40 are connected to each other in series between the drain of the field-effect transistor 32 and the source of the field-effect transistor 34. The primary coil $42_1$ of a transformer 42 (this will be described later on) is connected to the contact between the capacitors 38 and 40 and the other contact between the source side of the field-effect transistor 32 and the drain side of the field-effect transistor 34.

The transformer 42 is insulative, which is of the leakage type for example. The secondary coil $42_2$ of the transformer 42 makes up the AC output terminal of the inverter circuit 30. An end of the secondary coil $42_2$ is connected to an end of a filament 46 of a fluorescent lamp 44. Likewise, the other end of the secondary coil $42_2$ is connected to an end of the other filament 48 of the fluorescent lamp 44. A startup capacitor 50 is connected between the other ends of the filaments 46 and 48. The startup capacitor 50 and leakage inductance of the insulative transformer 42 jointly compose a series resonant circuit in this embodiment.

Next, functional operation of the fluorescent lamp lighting apparatus of the above embodiment is described below.

First, when the commercial AC power source 12 is turned ON, the AC output voltage is rectified by a rectifying circuit 14. Next, the rectified AC voltage is smoothed by a field capacitor 16, and then the smoothed output voltage is converted into a DC voltage before being output from the DC power source 10.

Next, the rectified and smoothed DC voltage is transmitted to the field-effect transistors 32 and 34. Simultaneously, these field-effect transistors 32 and 34 are alternately turned ON and OFF by high-frequency signal delivered from the oscillator 36 inside of the inverter circuit 30. Then, voltage of high-frequency power source is transmitted to the primary coil $42_1$ of the insulative leakage transformer 42. As a result, as is conventionally known, due to function of the series resonant circuit composed of the startup capacitor 50 and the leakage inductance, the fluorescent lamp 44 is preheated. Next, as soon as the voltage between electrodes of the fluorescent lamp 44 exceeds the startup voltage, the fluorescent lamp 44 illuminates itself.

Now, when the fluorescent lamp 44 is off from the lighting apparatus, some portions of the filaments 46 and 48 remain open. In other words, both ends of the secondary coil $42_2$ of the insulative leakage transformer 42 are held open to inactivate the operation of the series resonant circuit. In consequence, this results in the elimination of unwanted destruction of the field-effect transistors 32 and 34 in the inverter circuit 30.

Concretely, when no load is present in the lighting apparatus, only the excited inductance component remains in the leakage transformer 42 internally holding leakage inductance. Nevertheless, generally, the excited inductance contains a greater amount of inductance than that of the leakage inductance. As a result, only a negligible amount of current flows through the lighting apparatus while no load is present.

Furthermore, even when the fluorescent lamp 44 is off from the lighting apparatus, the inverter circuit 30 is still operative. As a result, when the fluorescent lamp 44 is loaded into the lighting apparatus, the fluorescent lamp 44 instantly illuminates itself.

In this way, the secondary coil $42_2$ of the leakage transformer 42 of the inverter circuit 30 energizes the fluorescent lamp 44. One of those elements composing the series resonant circuit is connected between filaments of the fluorescent lamp 44 on the side opposite from the power source. As a result, while the fluorescent lamp 44 is off from the lighting apparatus, the series resonant circuit is open. Accordingly, even when no load is present, there is no fear of destroying the inverter circuit 30. Furthermore, due to the presence of the insulative leakage transformer 42, the fluorescent lamp 44 is insulated from the DC power source. This in turn securely prevents electric shock from occurrence otherwise likely to take place in the course of loading and unloading the fluorescent lamp 44.

Figure 2:
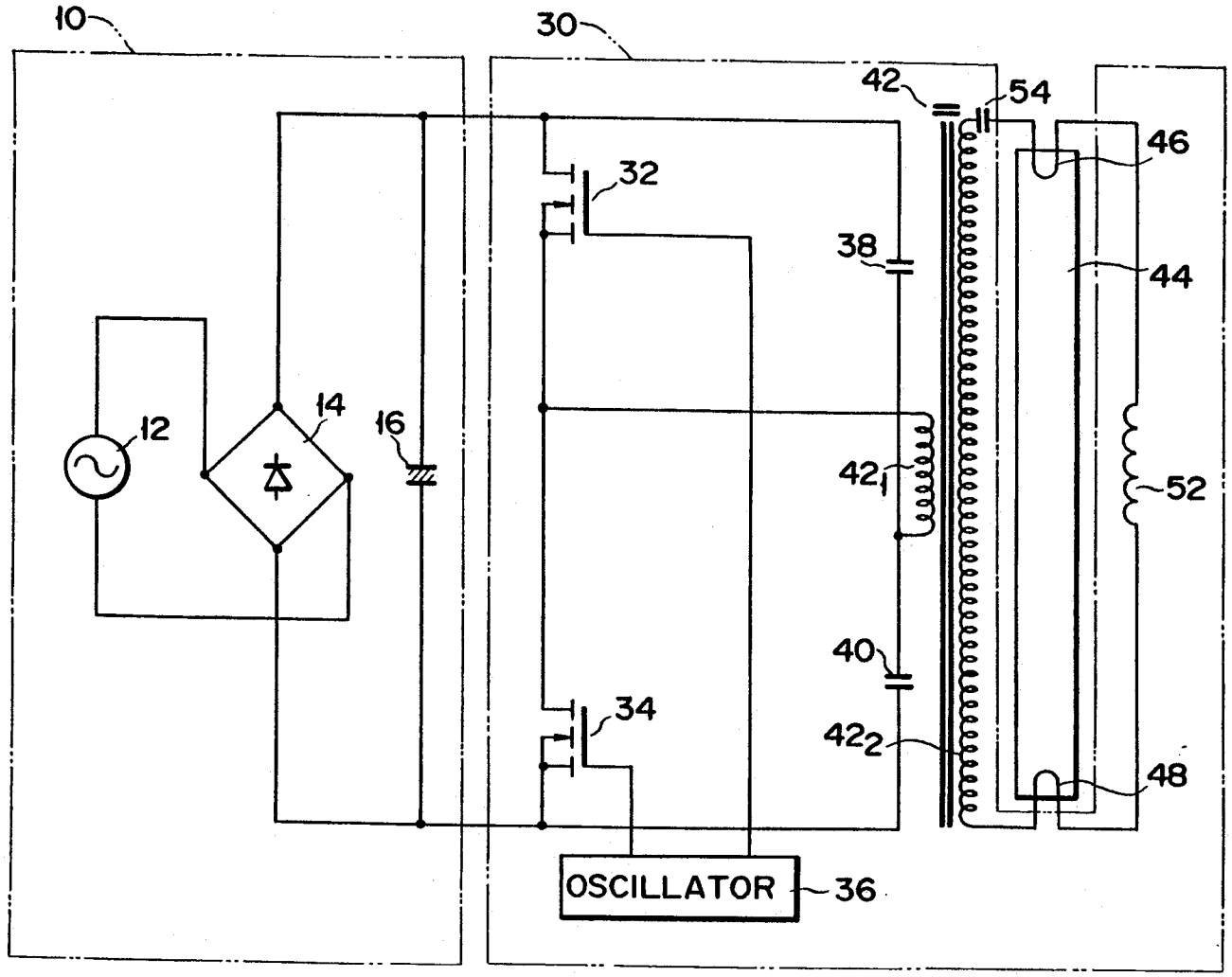
FIG. 2 is a schematic circuit block diagram of the fluorescent lamp lighting apparatus according to the second embodiment of the invention, in which an inductive component is connected to the fluorescent lamp in parallel.

FIG. 2 illustrates an example of the connection of an inductive element (a resonant coil 52) composing the series resonant circuit between the filaments 46 and 48 of the fluorescent lamp 44 on the side opposite from the power source in the first embodiment shown in FIG. 1. In this case, capacitor 54 is substantially a capacitance component available for resonance, where the capacitor 54 and the resonant coil 52 jointly make up the series resonant circuit. The capacitor 54 is connected between the filaments 46 and 48 on the power-supply side of the fluorescent lamp 44. Other aspects of the structure and operation of those circuits shown in FIG. 2 are identical to those of the first embodiment shown in FIG. 1, and therefore, description of these is deleted.

The above embodiments respectively refer to the use of the insulative leakage transformer 42. Nevertheless, the invention does not confine the scope of available transformers merely to this insulative leakage transformer 42.

Figure 3:
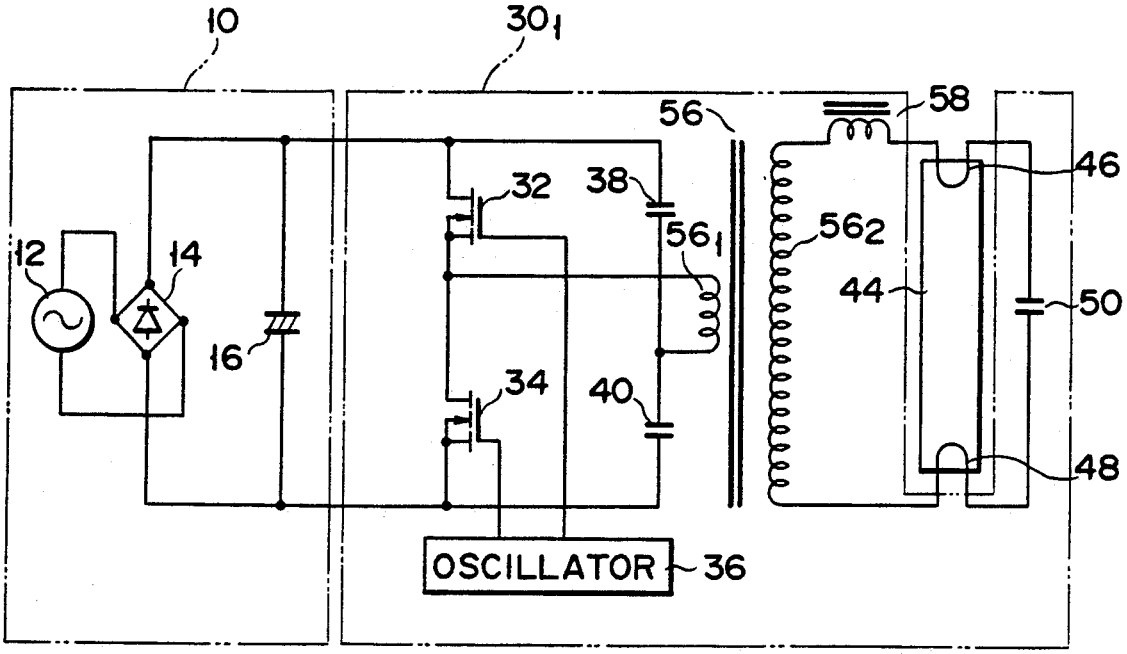
FIG. 3 is a schematic circuit block diagram of the fluorescent lamp lighting apparatus using a choke coil on the part of the secondary coil of an insulative transformer according to the third embodiment of the invention.

In this case, as shown in FIG. 3, a choke coil 58 concurrently serving as ballast is connected between the output terminal of a secondary coil $56_2$ inside of an inverter circuit $30_1$ and filament 46 of the fluorescent lamp 44. The series resonant circuit can be opened by the above structure when the fluorescent lamp 44 is not loaded in the lighting apparatus. Consequently, even when no load is present, there is no fear of causing the inverter circuit $30_1$ to be destroyed. Other aspects of the structure and operation of those circuits are identical to those of the preceding embodiments, and thus, description of these is deleted.

Figure 4:
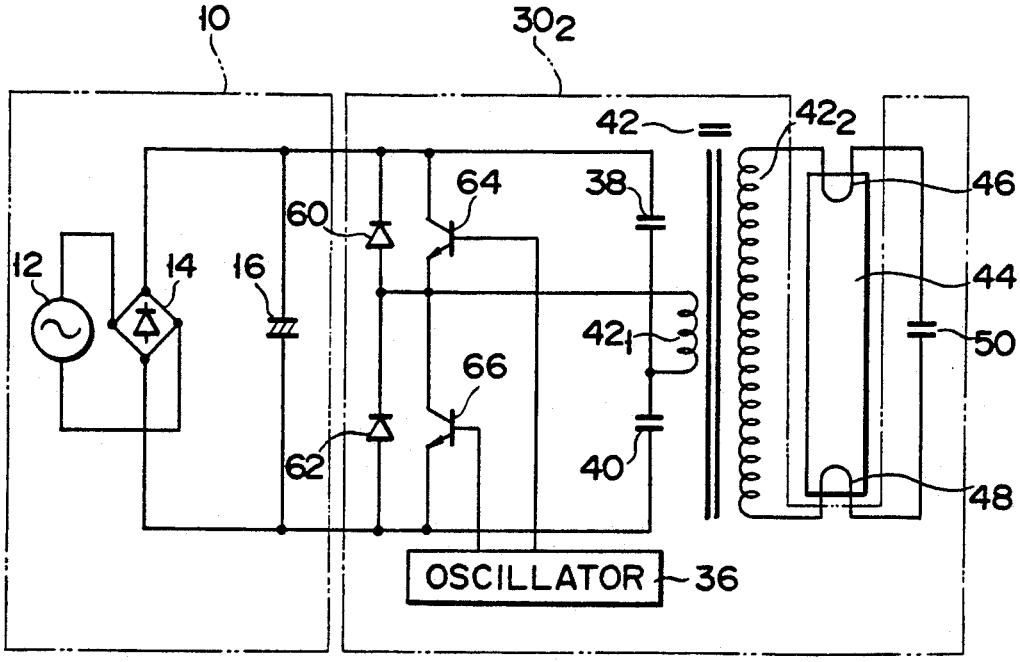
FIG. 4 is a schematic circuit block diagram of the fluorescent lamp lighting apparatus according to the fourth embodiment of the invention, in which a plurality of bipolar transistors compose switching elements of the inverter circuit.
Figure 5:
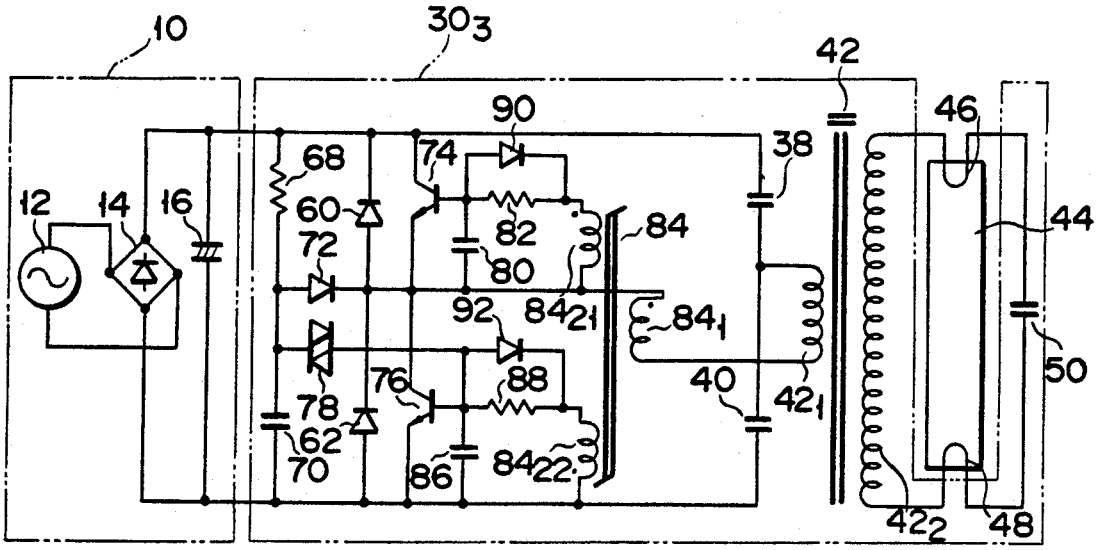
FIG. 5 is a schematic circuit block diagram of the self-exciting inverter-type fluorescent lamp lighting apparatus according to the fifth embodiment of the invention.

FIGS. 4 and 5 respectively illustrate other embodiments of the circuit structure of the inverter circuit 30 shown in FIG. 1. Regarding the circuit diagrams of the following embodiments, description shall merely refer to those components different from those which are shown in the preceding embodiments, where identical reference numerals will be given to those corresponding components. Since other aspects of the structure and operation of those circuits in the following embodiments are identical to those of the preceding embodiments, description of these is deleted.

FIG. 4 illustrates an embodiment in which a pair of bipolar transistors are available for composing switching elements inside of the inverter 30 of the fluorescent lamp lighting apparatus shown in FIG. 1. Diodes 60 and 62 which are connected to each other in series in the inverter circuit $30_2$ according to the illustrated polarity are respectively connected between the output terminals of the DC power source 10. Collectors and emitters of bipolar transistors 64 and 66 are connected to both terminals of the diodes 60 and 62. Bases of these bipolar transistors 64 and 66 are respectively connected to an oscillator 36, and thus, in response to the operation of the oscillator 36, alternate switching operations are executed between these bipolar transistors 64 and 66.

FIG. 5 illustrates an embodiment in which the inverter circuit 30 shown in FIG. 1 is replaced by a self-exciting inverter circuit $30_3$. Diodes 60 and 62 are connected to each other in series according to the illustrated polarity. These diodes 60 and 62 are also connected to a series circuit composed of a resistor 68 and a capacitor 70, while these diodes 60 and 62 are connected in parallel between output terminals of the DC power source 10. Another diode 72 is connected to the contact between the series circuit composed of the resistor 68 and the capacitor 70 and the contact between the diodes 60 and 62. Collector and emitter of a transistor 74 functioning as a switching element are respectively connected to the cathode and anode between both terminals of the diode 60. Like-wise, collector and emitter of a transistor 76 are respectively connected to the cathode and anode between both terminals of the diode 62. Along with the resistor 68 and the capacitor 70, a trigger diode 78 composing an activating circuit of the inverter circuit $30_3$ is connected to the contact between the series circuit composed of the resistor 68 and the capacitor 70 and the base of the transistor 76.

Along which capacitor 80, a resistor 82 and a series circuit of one of the secondary coil $84_{21}$ of a drive transformer 84 are also connected between the base and the emitter of the transistor 74. Likewise, along with a capacitor 86, a resistor 88 and a series circuit of the other secondary coil $84_{22}$ of the drive transformer 84 are also connected between the base and the emitter of the transistor 76. Diodes 90 and 92 are respectively connected to the resistors 82 and 88 in parallel. An end of the primary coil $84_1$ of the drive transformer 84 is connected to the contact between the transistors 74 and 76, whereas the other end is connected to the primary coil $42_1$ of the insulative leakage transformer 42.

When the commercial AC power source 12 is turned ON in the self-exciting inverter circuit $30_3$, the transistor 76 is turned ON via the trigger diode 78 composing the activating circuit. Simultaneously, AC current flows through a closed circuit composed of the transistor 76, capacitor 40, the primary coil $42_1$ of the insulative leakage transformer 42, and the primary coil $84_1$ of the drive transformer 84. When the AC current flows through the primary coil $84_1$ of the drive transformer 84, current is generated in the secondary coils $84_{21}$ and $84_{22}$ in response to it. As a result, the transistor 76 is turned OFF, whereas the transistor 74 is turned ON. This causes the AC current to flow through another closed circuit composed of the transistor 74, capacitor 38, the primary coil $42_1$ of the insulative leakage transformer 42, and the primary coil $84_1$ of the drive transformer 84 in the direction inverse from the last flow. As a result, the transistor 74 is turned OFF and the transistor 76 ON.

In this way, by causing transistors 74 and 76 to be turned ON and OFF and vice versa, in other words, by alternately switching these transistors 74 and 76, voltage from high-frequency power source is delivered to the primary coil $42_1$ of the insulative leakage transformer 42 before eventually lighting up the fluorescent lamp 44 as was done for the preceding embodiments.

Figure 6:
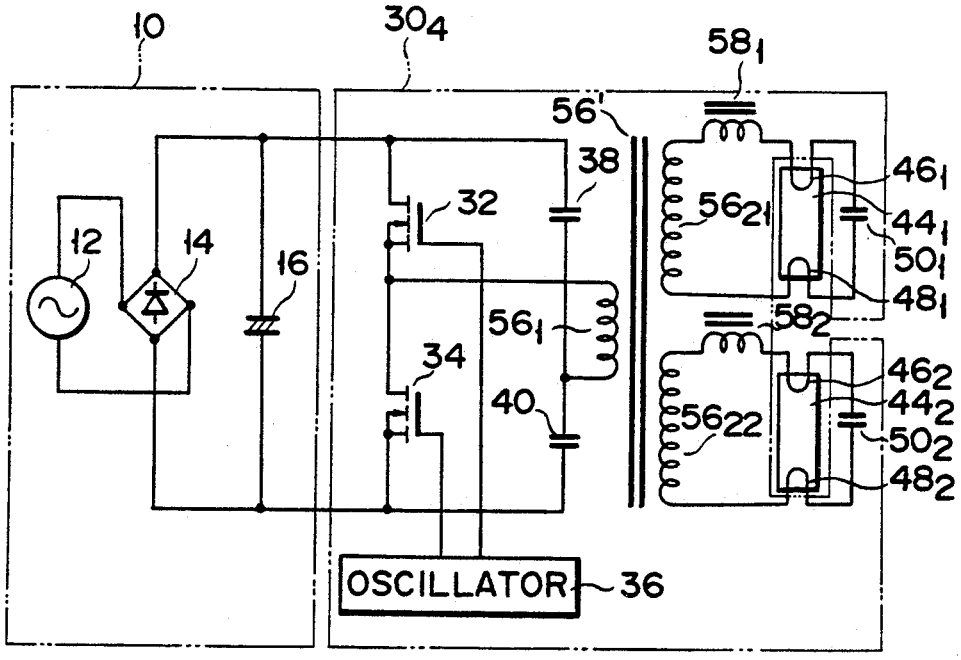
FIG. 6 is a schematic circuit block diagram of the fluorescent lamp lighting apparatus loaded with a pair of fluorescent lamps according to the sixth embodiment of the invention.

FIG. 6 illustrates an embodiment in which a plurality (like a pair) of fluorescent lamp circuits are provided on the part of the secondary coil of the transformer shown in FIG. 3. Concretely, a choke coil $58_1$ concurrently functioning as ballast is connected between the output terminal of a secondary coil $56_{21}$ of a transformer 56' inside of an inverter circuit $30_4$ and filament $46_1$ of a fluorescent lamp $44_1$. A capacitor $50_1$ is connected between the other ends of the filament $46_1$ and a filament $48_1$. Likewise, a choke coil $58_2$ concurrently functioning as ballast is connected between the output terminal of the other secondary coil $56_{22}$ of the transformer 56' and a filament $46_2$ of fluorescent lamp $44_2$. A capacitor $50_2$ is connected between the other ends of the filament $46_2$ and a filament $48_2$.

The above structure providing a plurality of fluorescent lamps on the part of the secondary coil of an insulative transformer can also achieve the identical effect to that is achieved by the preceding embodiments.

Figure 7:
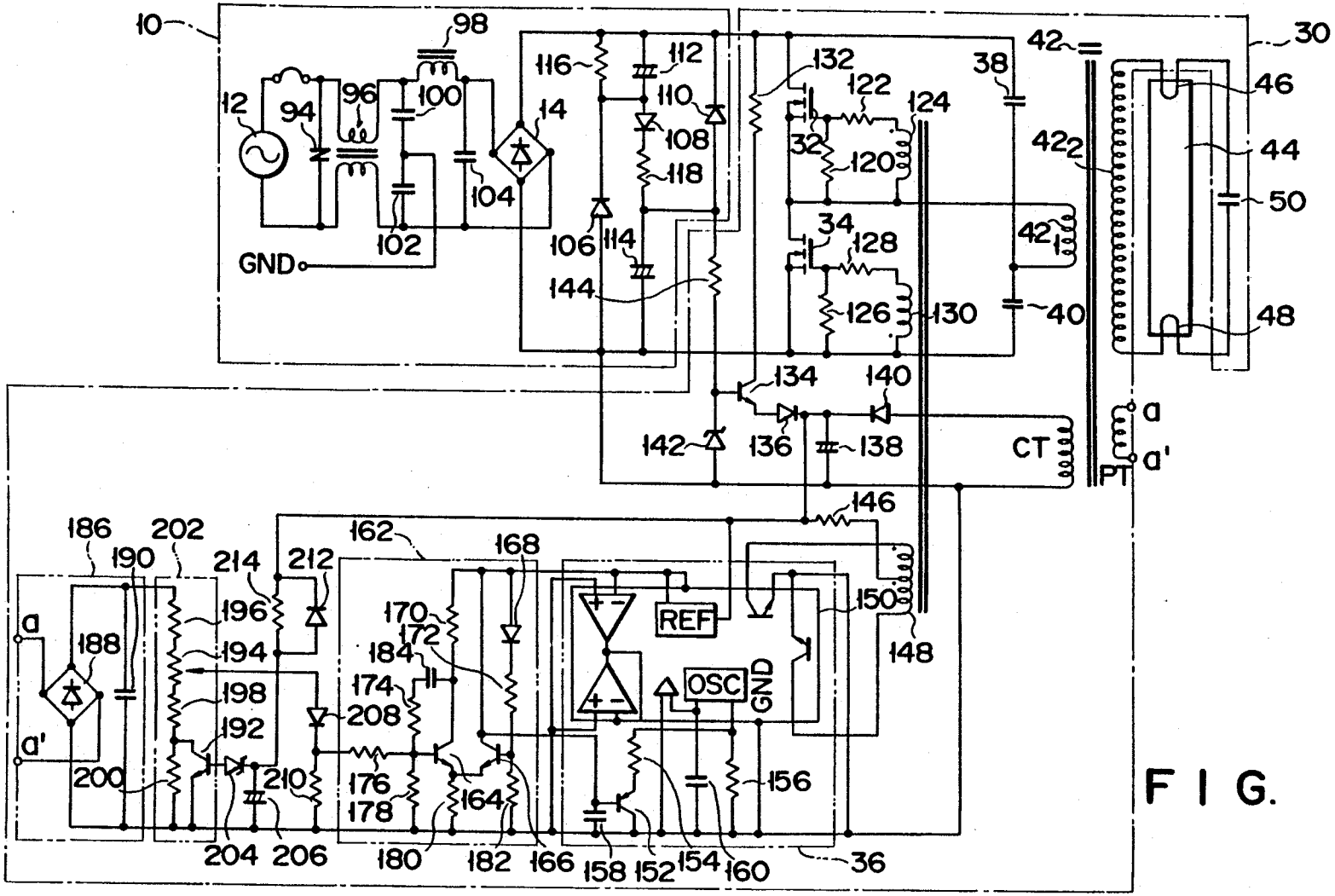
FIG. 7 is a concrete circuit block diagram of the fluorescent lamp lighting apparatus shown in FIG. 1 reflecting the seventh embodiment of the invention.

FIG. 7 illustrates the concrete circuit block diagram of the fluorescent lamp lighting apparatus according to the invention. DC power source 10 shown in FIG. 7 incorporates a rectifying circuit 14 which is connected between both terminals of AC power source 12 (having a semiconductor switch 94 connected in parallel) via a transformer 96 and a choke coil 98. The DC power source 10 also incorporates capacitors 100, 102 and 104 which are respectively connected to the rectifying circuit 14 in parallel. In addition to these, in order to smoothen current output from a rectifying circuit 52, the DC power source 10 also incorporates diodes 106, 108, and 110 each having the illustrated polarity, field capacitors 112 and 114, and resistors 116 and 118, respectively.

In addition to those transistors 32 and 34, the capacitors 38 and 40, and the insulative leakage transformer 42 containing the primary coil $42_1$ and the secondary coil $42_2$ shown in FIG. 1, the inverter circuit 30 further incorporates those components including the following; resistors 120 and 122, 126 and 128, and transformers 124 and 130 are respectively connected between the gates and sources of the field-effect transistors 32 and 34. A resistor 132, a transistor 134, and a diode 136, are respectively connected between the drain of the field-effect transistor 32 and the oscillator 36. A field capacitor 138 is connected to the diode 136. A diode 140, a current transformer CT, and a Zener diode 142, are respectively connected to the emitter of the transistor 134. A resistor 144 is connected between the base of the transistor 134 and a diode 110.

The oscillator 36 is connected to the transistor 134 via the diode 136, a resistor 146, and a transformer 148. As shown in FIG. 7, the oscillator 36 incorporates a V/F converter 150 converting voltage into frequency for example, a transistor 152, resistors 154 and 156, and capacitors 158 and 160. The oscillator 36 is connected to a differential amplifier 162 which is composed of transistors 100 and 104, a diode 166, resistors 170, 172, 174, 176, 178, 180 and 182, and a capacitor 184, as shown in FIG. 7.

The reference numeral 186 designates a voltage detection circuit. The voltage detection circuit 186 incorporates a voltage-detecting coil PT of the insulative leakage transformer 42, a rectifying circuit 188 whose input terminal is connected to the voltage-detecting coil PT, and a voltage-smoothing capacitor 190 which is connected to the output terminal of the rectifying circuit 188.

The voltage detection circuit 186 is connected to a soft-start circuit 202 which is composed of a transistor 192, a variable resistor 194, and resistors 196, 198 and 200. A serial circuit composed of a Zener diode 204 and a field capacitor 206, the other serial circuit composed of a diode 208 and a resistor 210, and a parallel circuit composed of a diode 202 and a resistor 214, are respectively connected between the soft-start circuit 202 and the oscillator 36.

As far as a fluorescent lamp is energized by the secondary coil of a transformer of the inverter circuit and one of elements composing a series resonant circuit is connected between filaments on the side opposite from the power source of the fluorescent lamp, the scope of the invention is not solely confined to those embodiments described above, but the invention also provides a variety of applicable fields as well.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An apparatus for lighting a fluorescent lamp, said apparatus comprising:

means for supply DC voltage;

first and second means, coupled in series between output terminals of said DC voltage supplying means and being alternately energized, for switching said DC voltage provided by said DC voltage supplying means and outputting switching signals;

a primary-secondary insulative transformer comprising a primary winding and a secondary winding, said primary winding and said secondary winding being electrically isolated from each other and capable of being magnetically coupled, said switching signals being supplied to said primary winding, said primary winding comprising first and second terminals and said secondary winding comprising first and second output terminals and providing output signals at said first and second output terminals in accordance with said switching signals;

a fluorescent lamp comprising first and second filaments, said first filament comprising first and second ends and said second filament comprising first and second ends, said first end of said first filament being coupled to said first output terminal of said secondary winding of said insulative transformer and said first end of said second filament being coupled to said second output terminal of said secondary winding such that said output signals are provided from said first and said second output terminals of said secondary winding to said first and said second filaments; and a series resonant circuit comprising one of a first circuit and a second circuit, said first circuit comprising a first inductance component and a first capacitance component, said first inductance component having first and second ends and said first capacitance component having first and second ends, said first end of said first inductance component being coupled to said first end of said first filament and said second end of said first inductance component being coupled to said first end of said second filament, said first end of said first capacitance component being coupled to said second end of said first filament and said second end of said first capacitance component being coupled to said second end of said second filament, and said second circuit comprising a second inductance component and a second capacitance component, said second inductance component having first and second ends, said second capacitance component being coupled to said first end of said first filament and said first end of said second filament in series with said secondary winding of said insulative transformer, said first end of said second inductance component being coupled to said second end of said first filament and said second end of said second inductance component being coupled to said second end of said second filament.

2. An apparatus according to claim 1, wherein said series resonance circuit comprises said first circuit, said first inductance component being said secondary winding of said insulative transformer.

3. An apparatus according to claim 1, wherein said series resonance circuit comprises said second circuit.

4. An apparatus according to claim 1, wherein said insulative transformer comprises a leakage transformer.

5. An apparatus according to claim 1, further comprising oscillation means, coupled to said first and said second switching means, for driving said first and said second switching means.

6. An apparatus according to claim 5, wherein said oscillation means comprises an oscillator.

7. An apparatus according to claim 1, wherein each of said switching means comprise a transistor.

8. An apparatus according to claim 1, wherein said series resonant circuit comprises said first circuit, said first inductance component being coupled in series with said secondary winding of said insulative transformer.

9. An apparatus according to claim 7, wherein each of said switching means comprise a field-effect transistor.

10. An apparatus according to claim 7, wherein each of said switching means comprise a bipolar transistor.

11. An apparatus according to claim 5, wherein said first and second switching each comprise a control terminal, said control terminals being coupled to said oscillation means, said series resonant circuit comprising said first circuit, said apparatus further comprising first and second voltage-dividing capacitors, said first and said second voltage-dividing capacitors being coupled in series with each other and in parallel with said DC power source, said first terminal of said primary coil of said insulative transformer being coupled said first and said second switching elements and said second terminal of said primary coil of said insulative transformer being coupled between said first and said second voltage-dividing capacitors.

12. An apparatus according to claim 5, wherein said first and second switching each comprise a control terminal, said control terminals being coupled to said oscillation means, said series resonant circuit comprising said second circuit, said apparatus further comprising first and second voltage-dividing capacitors, said first and said second voltage-dividing capacitors being coupled in series with each other and in parallel with said DC power source, said first terminal of said primary coil of said insulative transformer being coupled said first and said second switching elements and said second terminal of said primary coil of said insulative transformer being coupled between said first and said second voltage-dividing capacitors.

13. An apparatus according to claim 5, wherein said first and second switching each comprise a control terminal, said control terminals being coupled to said oscillation means, said series resonant circuit comprising said first circuit, said apparatus further comprising choke coils coupled to said first ends of said first and said second filaments in series with said secondary winding of said insulative transformer and first and second voltage-dividing capacitors, said first and said second voltage-dividing capacitors being coupled in series with each other and in parallel with said DC power source, said first terminal of said primary coil of said insulative transformer being coupled said first and said second switching elements and said second terminal of said primary coil of said insulative transformer being coupled between said first and said second voltage-dividing capacitors.

14. An apparatus for lighting a fluorescent lamp, said apparatus comprising:

means for supplying DC voltage;

self-exciting inverter circuit means, coupled to said DC voltage supplying means, for converting said DC voltage into AC voltage, said self-exciting inverter circuit means comprising:

first and second means, coupled in series between output terminals of said DC voltage supplying means and being alternately energized, for switching said DC voltage provided by said DC voltage supplying means and outputting switching signals;

a primary-secondary insulative transformer comprising a primary winding and a second winding, said primary winding and said second winding being electrically isolated from each other and capable of being magnetically coupled, said switching signals being supplied to said primary winding, said second winding comprising first and second output terminals and providing output signals at said first and second output terminals in accordance with said switching signals; and a series resonant circuit comprising an inductance component and a capacitance component, said inductance component being said second winding of said insulative transformer and said capacitance component having first and second ends; and a fluorescent lamp comprising first and second filaments, said first filament comprising first and second ends and said second filament comprising first and second ends, said first end of said first filament being coupled to said first output terminal of said second winding of said insulative transformer and said first end of said second filament being coupled to said second output terminal of said secondary winding such that said output signals are provided from said first and said second output terminals of said secondary winding to said first and said second filaments, and said second end of said first filament being coupled to said first end of said capacitance component and said second end of said second filament being coupled to said second end of said capacitance component.

15. An apparatus for lighting a fluorescent lamp, said apparatus comprising:

means for supplying DC voltage;

inverter circuit means, coupled to said DC voltage supplying means, for converting said DC voltage into AC voltage, said inverter circuit means comprising:

first and second means, coupled in series between output terminals of said DC voltage supplying means and being alternately energized, for switching said DC voltage provided by said DC voltage supplying means and outputting switching signals, a primary-secondary insulative transformer comprising a primary winding and a secondary winding, said primary winding and said second winding being electrically isolated from each other and capable of being magnetically coupled, said switching signals being supplied to said primary winding, said secondary winding comprising first and second output terminals and providing output signals at said first and second output terminals in accordance with said switching signals, a series resonant circuit comprising an inductance component and a capacitance component, said inductance component being said secondary winding of said insulative transformer and said capacitance component having first and second ends, an oscillator coupled to said first and said second switching means, a differential amplifier coupled to said oscillator, a soft-start circuit coupled to said differential amplifier, and a voltage-detection circuit, coupled to said differential amplifier and said insulative transformer, for detecting a voltage from said insulative transformer; and a fluorescent lamp comprising first and second filaments, said first filament comprising first and second ends and said second filament comprising first and second ends, said first end of said first filament being coupled to said first output terminal of said second winding of said insulative transformer and said first end of said second filament being coupled to said second output terminal of said secondary winding such that said output signals are provided from said first and said second output terminals of said secondary winding to said first and said second filaments, and said second end of said first filament being coupled to said first end of said capacitance component and said second end of said second filament being coupled to said second end of said capacitance component.

* * * * *